US012077722B2

(12) United States Patent
Zhao et al.

(10) Patent No.: US 12,077,722 B2
(45) **Date of Patent: *Sep. 3, 2024**

(54) WATER BASED SEMI-SYNTHETIC METALWORKING FLUID COMPOSITION

(71) Applicant: Dow Global Technologies LLC, Midland, MI (US)

(72) Inventors: Chao Zhao, Shanghai (CN); Xue Chen, Manvel, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/252,450

(22) PCT Filed: Aug. 24, 2021

(86) PCT No.: PCT/CN2021/114210
§ 371 (c)(1),
(2) Date: May 10, 2023

(87) PCT Pub. No.: WO2023/023925
PCT Pub. Date: Mar. 2, 2023

(65) Prior Publication Data

US 2023/0303947 A1 Sep. 28, 2023

(51) Int. Cl.

| | |
|---|---|
| ***C10M 173/00*** | (2006.01) |
| ***C10M 133/06*** | (2006.01) |
| *C10N 30/16* | (2006.01) |
| *C10N 40/22* | (2006.01) |
| *C10N 50/00* | (2006.01) |

(52) U.S. Cl.
CPC ..... *C10M 173/00* (2013.01); *C10M 133/06* (2013.01); *C10M 2201/02* (2013.01); *C10M 2215/042* (2013.01); *C10N 2030/16* (2013.01); *C10N 2040/22* (2013.01); *C10N 2050/011* (2020.05)

(58) Field of Classification Search
CPC ..... C10M 173/00; C10M 133/06; C10N 2040/20; C10N 2050/011; C10N 2050/013
See application file for complete search history.

(56) References Cited

U.S. PATENT DOCUMENTS

| | | | | |
|---|---|---|---|---|
| 5,132,046 | A | 7/1992 | Edebo et al. | |
| 5,716,917 | A | 2/1998 | Williams et al. | |
| 5,863,874 | A * | 1/1999 | Person Hei | C10M 173/02 508/525 |
| 7,595,288 | B2 * | 9/2009 | Fretz | C10M 173/02 508/156 |

(Continued)

FOREIGN PATENT DOCUMENTS

| | | | |
|---|---|---|---|
| CN | 101063634 | B | 6/2012 |
| EP | 1529832 | A1 | 5/2005 |

(Continued)

OTHER PUBLICATIONS

PCT/CN2021/114210 International Search Report and Written Opinion with a mailing date of Apr. 26, 2022.

*Primary Examiner* — Vishal V Vasisth

(57) ABSTRACT

The present invention describes a water based semi-synthetic metal working fluid comprising a base oil, an organic acid, emulsifiers, optionally a concentrate additive, water and a microbial growth control agent which comprises a glycol ether amine.

11 Claims, 1 Drawing Sheet

(56) References Cited

U.S. PATENT DOCUMENTS

| | | | | |
|---|---|---|---|---|
| 9,587,197 | B2 | 3/2017 | Duncan et al. | |
| 9,957,458 | B2 | 5/2018 | G. S. et al. | |
| 2003/0168626 | A1 | 9/2003 | Eastwood et al. | |
| 2008/0255215 | A1 | 10/2008 | Gernon et al. | |
| 2010/0093736 | A1* | 4/2010 | Coburn ..... | A01N 43/80<br>507/131 |

FOREIGN PATENT DOCUMENTS

| | | | |
|---|---|---|---|
| JP | 2009161585 | A | 7/2009 |
| JP | 4728157 | B2 | 7/2011 |
| WO | 1994012028 | A1 | 6/1994 |
| WO | 1996028459 | A1 | 9/1996 |

* cited by examiner

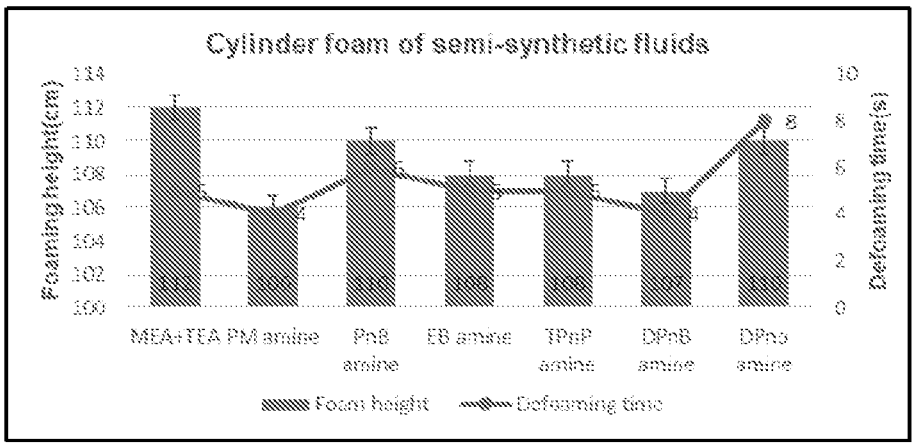
Cylinder foam of semi-synthetic fluids
Foaming height(cm)
114
112
110
108
106
104
102
100
Defoaming time(s)
10
8
6
4
2
0
MEA+TEA PM amine
PnB amine
EB amine
TPnP amine
DPnB amine
DPnp amine
Foam height
Defoaming time

WATER BASED SEMI-SYNTHETIC METALWORKING FLUID COMPOSITION

This application is a 371 of PCT/CN2021/114210, filed Aug. 24, 2021.

Semi-synthetic metal working fluid compositions are provided which compositions include a microbial growth control agent comprising a particular class of glycol ether amines.

INTRODUCTION

Metal working fluids (MWFs) are used for lubrication of metal cutting and tool forming. These fluids provide cooling for the metal work tooling, removal of cutting chips from the tool/work piece interface and help provide an acceptable post-machining finished surface. In recent years, with the development of metal processing for vehicles containing materials such as aluminum, the requirements of metalworking fluids have become more demanding.

The metalworking fluid industry desires compositions which have good cooling performance, good lubricity, good concentrate stability and long shelf life. Existing MWFs are typically classified as neat oil, soluble oil, semi-synthetic fluid, or synthetic fluid, with category exhibiting different functions of cooling, lubricating, anti-rust and cleaning. Soluble oil MWFs comprise 50-70 wt. % neat oil with the remainder of the MWF being anti-wear/extreme pressure additives and emulsifiers. Neat oils and Soluble oils typically do not provide the same level of cooling compared with water-based metalworking fluids. Synthetic fluids typically cannot provide the good lubricity performance because their lubricity function is affected by polyalkylene glycol reverse dissolution when the temperature is higher than cloud point. Semi-synthetic materials offer the possibility of simultaneously providing good lubricity and cooling for use in demanding applications. A typical semi-synthetic fluid consists of oils, organic acids, detergents, surfactants, lubricants, amines, anti-corrosion agents, water and other ingredients. The amount of water in such semi-synthetic MWFs is typically up to 50-60 wt. %, with around 10-40 wt. % mineral oil, around 10-20 wt. % emulsifiers, around 10-20 wt. % amine, and other functional additives such as lubricant, corrosion inhibitor, solubilizer, pH neutralizer, biocide etc. Semi-synthetic MWFs are usually diluted with additional water at an end user's site to a concentration of 1-20 wt. % neat oil, more typically 5-7 wt. % concentration of neat oil.

In semi-synthetic fluids, emulsifiers are often added to form stable dispersion of oil in water. Emulsifier particles are located around the oil droplets to give them a negative charge that will bind them to the water molecules. The size of such emulsified oil drops is very important to fluid performance, as it is generally easier for the smaller emulsion sizes to penetrate the interface of the cutting zone. The emulsifiers also contribute to the stability of semi-synthetic fluids.

Semi-synthetic fluids will degrade over time in part due to microbial growth which negatively impacts fluid performance because microbes feed on the active ingredients in the fluid. Such microbial growth in the MWFs may cause serious problems in metalworking processing in many forms including: MWFs general souring, MWFs viscosity changing, MWFs shelf life shortening, and the corroding of tools and materials. Additionally, the functioning of equipment and processes such as feeding nozzles, storage tanks, pipelines and recycling system facilities may also be impacted by microbe growth in MWFs. This souring increases the cost of MWFs, accelerates corrosion rates and decreases efficiency of metal processing. The most common solution to control microbial growth is to add biocides and amine alcohols either continuously or as a batch treatment to a given MWF. However, biocides and some secondary amine alcohols are limited by regulatory restrictions and most of the biocide chemicals will release formaldehyde over time which is hazardous to human health.

It is therefore desired to have new semi-synthetic metal working formulations with new biocidal compositions which provide improved cooling, lubricity, concentrate stability, and long shelf life, without the environmental health and safety concerns of present fluids.

The compositions of the present invention address some or all of the above-described needs.

SUMMARY

The present invention describes a water based semi-synthetic metal working fluid comprising a base oil, an organic acid, emulsifiers, optionally a additive, water and a microbial growth control agent which comprises a glycol ether amine.

BRIEF DESCRIPTION OF THE DRAWINGS

FIG. 1 is a bar graph showing the foaming heights and the defoaming times for Comparative Example 1 and examples 1-6 of the present invention.

DETAILED DESCRIPTION

The present invention relates to semi-synthetic metal working fluids. These MWFs comprise water, one or more base oils, one or more solubilizers, one or more emulsifiers, optionally one or more additives and one or more microbial growth control agents, where the microbial growth control agent comprises at least a glycol ether amine.

The water used in the present formulations is preferably deionized water, and may comprise from at least 20, preferably 25, 30, or even 35 percent by weight of the formulation up to a maximum of 65, 60, 55 or even 50 percent by weight of the formulation. It is contemplated that these formulations may be further diluted with additional water prior to use, altering these ranges accordingly. For example, prior to use, the formulations may be diluted such that the base oil concentration is from 1 to 20 percent by weight of the diluted formulation, more typically 5 to 7 percent by weight.

The semi-synthetic MWFs of the present invention also include a base oil. The base oil can be any base oil generally known in the art for use in MWFs. Preferably the base oil is a base oil selected from naphthenic oils, paraffinic oils or ester oils, or combinations thereof. The concentration of the base oil(s) in the MWF may range from 5, 7, 10, or 15 percent by weight of the formulation up to 50, 45, 40, or 35 percent of the formulation.

The semi-synthetic MWFs of the present invention also include a microbial growth control agent and/or biocide, which may be described, in one embodiment, as a glycol ether amine. Suitable glycol ether amines include, but are not limited to: 2-butoxy-ethanamine, 1-methoxy-2-propanamine, 1-butoxy-2-propanamine, 1-[1-methyl-2-(1-methyl-2-propoxyethoxy)ethoxy]-2-propanamine1-(2-butoxy-1-methylethoxy)-2-propanamine, 1-(2-methoxy-1-methylethoxy)-2-propanamine and 1-(1-methyl-2-propoxyethoxy)-2-propanamine, and 2-amino-2-methyl-2-propanol. It was surpassingly found that such glycol ether amines are good biocides against bacteria and other microbes present in MWFs.

In another embodiment, the presently disclosed biocidal composition may be a composition comprising at least a glycol ether amine, wherein the primary ether amine compound is of the formula below:

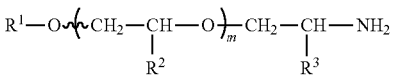

Wherein R1 is a C1-C6 alkyl group, more preferably C3-C4 alkyl group, and R2 and R3 are independently CH3 or CH2-CH3, and, m is 0 to 6, or, preferably, from 0 to 2.

The concentration of the glycol ether amine(s) in the MWF may range from 1, 4, 6, 8, or 10 percent by weight of the formulation up to 30, 25, 15, or 12 percent of the formulation.

The microbial growth control agent may further comprise one or more additional glycol ether amines which may be used in combination with the above disclosed materials to achieve a certain microbial growth control targets.

The semi-synthetic MWFs of the present invention also include one or more organic acids as solubilizers. Preferred organic acids include 2-ethylhexoic acid, azelaic acid, toll oil fatty acid, 12-hydoxyl-(cis)-9-octadecenoic acid, dicarboxylic acid, and 9-octadecenoic acid. The concentration of the organic acid in the MWF may range from 2, 3, 4, or 5 percent by weight of the formulation up to 12, 10, 8, or 7 percent of the formulation.

The semi-synthetic MWFs of the present invention also include one or more emulsifiers. The emulsifier may be anionic, cationic or nonionic. Examples of suitable anionic surfactants or emulsifiers are alkali metal, ammonium and amine soaps; the fatty acid part of such soaps contains preferably at least 10 carbon atoms. The soaps can also be formed "in situ;" in other words, a fatty acid can be added to the oil phase and an alkaline material to the aqueous phase.

Other examples of suitable anionic surfactants or emulsifiers are alkali metal salts of alkyl-aryl sulfonic acids, sodium dialkyl sulfosuccinate, sulfated or sulfonated oils, e.g., sulfated castor oil; sulfonated tallow, and alkali salts of short chain petroleum sulfonic acids.

Suitable cationic surfactants or emulsifiers are salts of long chain primary, secondary or tertiary amines, such as oleylamide acetate, cetylamine acetate, di-dodecylamine lactate, the acetate of aminoethyl-aminoethyl stearamide, dilauroyl triethylene tetramine diacetate, 1-aminoethyl-2-heptadecenyl imidazoline acetate; and quaternary salts, such as cetylpyridinium bromide, hexadecyl ethyl morpholinium chloride, and diethyl di-dodecyl ammonium chloride.

Examples of suitable nonionic surfactants or emulsifiers are condensation products of higher fatty alcohols with ethylene oxide, such as the reaction product of oleyl alcohol with 10 ethylene oxide units; condensation products of alkylphenols with ethylene oxide, such as the reaction product of isoctylphenol with 12 ethylene oxide units; condensation products of higher fatty acid amides with 5, or more, ethylene oxide units; polyethylene glycol esters of long chain fatty acids, such as tetraethylene glycol monopalmitate, hexaethyleneglycol monolaurate, nonaethyleneglycol monostearate, nonaethyleneglycol dioleate, tridecaethyleneglycol monoarachidate, tricosaethyleneglycol monobehenate, tricosaethyleneglycol dibehenate, polyhydric alcohol partial higher fatty acid esters such as sorbitan tristearate, ethylene oxide condensation products of polyhydric alcohol partial higher fatty acid esters, and their inner anhydrides (mannitol-anhydride, called Mannitan, and sorbitol-anhydride, called Sorbitan), such as glycerol monopalmitate reacted with 10 molecules of ethylene oxide, pentaerythritol monooleate reacted with 12 molecules of ethylene oxide, sorbitan monostearate reacted with 10-15 molecules of ethylene oxide, mannitan monopalmitate reacted with 10-15 molecules of ethylene oxide; long chain polyglycols in which one hydroxyl group is esterified with a higher fatty acid and other hydroxyl group is etherified with a low molecular alcohol, such as methoxypolyethylene glycol 550 monostearate (550 meaning the average molecular weight of the polyglycol ether). A combination of two or more of these surfactants may be used; e.g., a cationic may be blended with a nonionic or an anionic with a nonionic.

Suitable emulsifiers include C16-18 alcohols which have been ethoxylated or propoxylated; ethoxylated C12-C15 alcohols; sodium alkane sulfonate and alky ether carboxylates.

The concentration of the emulsifier(s) in the MWF may range from 4, 5, 6, 8, or 10 percent by weight of the formulation up to 25, 20, 15, or 12 percent of the formulation.

The semi-synthetic MWFs of the present invention may also include one or more additives. Preferred additives include diethylene glycol butyl ether, ethylene glycol monobutyl ether, and propylene glycol butyl ether. The concentration of the additive(s) in the MWF may range from 0.0, 0.3, 0.5, 1.0, or 1.5 percent by weight of the formulation up to 2.5, 2.0, or 1.8 percent of the formulation.

The semi-synthetic MWFs of the present invention may also include other additives to provide additional functionality as generally known in the art.

EXAMPLES

An experiment to test the efficacy of the presently disclosed semi-synthetic MWFs and others may be conducted as follows. A series of 7 semi-synthetic MWFs are prepared as indicated in Table 1. Each example is identical except for a different amine as a microbial growth control agent as shown in Table 2.

TABLE 1

Diluted Metalworking Fluid Ingredients

| Ingredient | details | percentage |
|---|---|---|
| Base oil | Naphthenic oil | 12.5 wt % |
| Organic acid | Azelaic acid | 4.5 wt % |
| | Toll oil fatty acid | 4.5 wt % |
| Emulsifiers | UCONTM Metalworking EMU 50 | 8.4 wt % |
| | UCONTM Metalworking EMU 60 | 2.0 wt % |
| | Sodium alkane sulfonate | 2.5 wt % |
| Amine | See Table 2 | 10.7 wt % |
| Additive | Diethylene glycol butyl ether | 2.0 wt % |
| Deionized water | / | 52.9 wt % |

TABLE 2

| Ether Amines Tested | | |
|---|---|---|
| Example | Amine | Product Name |
| Comparative Example 1 | MEA + TEA | Monoethanolamine (3.9 wt %), Triethanolamine (6.8 wt %) |
| Example 1 | PM amine | 1-methoxy-2-propanamine |
| Example 2 | PnB amine | 1-butoxy-2-propanamine |
| Example 3 | EB amine | 2-butoxy-ethanamine |
| Example 4 | TPnP amine | 1-[1-methyl-2-(1-methyl-2-propoxyethoxy)ethoxy]-2-propanamine |
| Example 5 | DPnB amine | 2-propanamine, 1-(2-butoxy-1-methylethoxy)- |
| Example 6 | DPnP amine | 1-(1-methyl-2-propoxyethoxy)-2-propanamine |

Test 1 Thermal Stability of Semi-Synthetic Fluid

A portion of each of the seven examples described above are stored at 500 (±3° C.) and a portion was stored at 0° C. (±1° C.) for 20 hours. Afterwards the samples are observed, and the results are shown in table 3, with "pass" indicating a single-phase clear material:

TABLE 3

| Thermal stability performance | | | |
|---|---|---|---|
| Semi-synthetic fluid | amine | Hot aging stability test 50° C., 20 h | Cold aging stability test 0° C., 20 h |
| Comparative Example 1 | MEA + TEA | Hazy | Hazy |
| Example 1 | PM amine | Pass | Hazy |
| Example 2 | PnB amine | Pass | Pass |
| Example 3 | EB amine | Hazy | Pass |
| Example 4 | TPnP amine | Separated | Pass |
| Example 5 | DPnB amine | Hazy | Pass |
| Example 6 | DPnp amine | Pass | Pass |

As shown in the above Table, the inventive composition (Examples 1-6) have demonstrated better stability than the comparative example 1, because all the examples have passed the stability test at least one of the temperatures.

Test 2 Foaming Tests 5.0 g of each of the first seven semi-synthetic fluid concentrates are added into a 250 mL cylinder containing 95 mL hard water (50 ppm, Ca(CO3)2 equivalents). After closing the cylinder with the stopper, the cylinder is inverted 60 times within 1 min. The foam volume height immediately after completing the inversions (0 sec) and time until the foam height was reduced 0 cm are recorded and presented in FIG. 1:

As shown in the above Table, the inventive compositions (Examples 1-5) have a better low foam performance than the comparative example 1 (MEA+TEA), because all the examples show lower foam height and lower defoaming time.

Test 3 Anti-Corrosion Test

To evaluate the anti-corrosion capability of semi-synthetic solutions, 5 ml of each of the hard water solutions used in test 2 are added to a 35 mm by 10 mm plastic petri dish along with 4.0 (±0.1) gm of cast icon chips and stored at 25'C for 24 h. After this period the corrosion status of the iron chips are observed, and area percentage observed to be affected is recorded in Table 4.

TABLE 4

| Anti-Corrosion Performance | | |
|---|---|---|
| Semi-synthetic fluid | Glycol ether amine | Corrosion area percentage (%) |
| Comparative Example 1 | MEA + TEA | 0 |
| Example 1 | PM amine | 0 |
| Example 2 | PnB amine | 4 |
| Example 3 | EB amine | 0 |
| Example 4 | TPnP amine | 32 |
| Example 5 | DPnB amine | 11 |
| Example 6 | DPnp amine | 0 |

As shown in the above Table 4, the inventive composition (Examples 1, 3, 6) have an equivalent anti-corrosion capability with comparative example 1 (MEA+TEA).

The invention claimed is:

1. A semi-synthetic metal working fluid, comprising:

a. at least one base oil;

b. at least one microbial growth control agent comprising a glycol ether amine selected from the group consisting of 1-[1-methyl-2-(1-methyl-2-propoxyethoxy)ethoxy]-2-propanamine, 1-(2-butoxy-1-methylethoxy)-2-propanamine, 1-(2-methoxy-1-methylethoxy)-2-propanamine, or 1-(1-methyl-2-propoxyethoxy)-2-propanamine;

c. one or more organic acids, d. one or more emulsifiers, e. optionally, one or more additives, and f. water.

2. The semi-synthetic metal working fluid of claim 1, wherein the microbial growth control agent further comprises an amine other than the glycol ether amine selected for b.

3. The semi-synthetic metal working fluid of claim 1, wherein the base oil is selected from naphthenic oils, paraffinic oils, ester oils and mixtures thereof.

4. The semi-synthetic metal working fluid of claim 1, wherein the emulsifier is selected from $C_{16}$-$C_{18}$ alcohols which have been ethoxylated or propoxylated, ethoxylated $C_{12}$-$C_{15}$ alcohols, sodium alkane sulfonate and alky ether carboxylates and mixtures thereof.

5. The semi-synthetic metal working fluid of claim 1, further comprising a solubilizer, wherein the solubilizer is selected from ethylhexoic acid, azelaic acid, tall oil fatty acid, 12-hydoxyl-(cis)-9-octadecenoic acid, dicarboxylic acid, 9-octadecenoic acid and mixtures thereof.

6. The semi-synthetic metal working fluid of claim 1, wherein the additive is present and is selected from diethylene glycol butyl ether, ethylene glycol monobutyl ether, propylene glycol butyl ether and mixtures thereof.

7. The semi-synthetic metal working fluid of claim 1, wherein the microbial growth control agent is present in an amount of from 6 to 15 percent by weight of the semi-synthetic metal working fluid.

8. The semi-synthetic metal working fluid of claim 1, wherein the base oil is present in an amount of from 10 to 45 percent by weight of the semi-synthetic metal working fluid.

9. The semi-synthetic metal working fluid of claim 1, wherein the emulsifier is present in an amount of from 5 to 20 percent by weight of the semi-synthetic metal working fluid.

10. The semi-synthetic metal working fluid of claim 1, wherein the solubilizer is present in an amount of from 3 to 10 percent by weight of the semi-synthetic metal working fluid.

11. The semi-synthetic metal working fluid of claim 1, wherein the water is present in an amount of from 20 to 60 percent by weight of the semi-synthetic metal working fluid.

* * * * *